US005542264A

United States Patent [19]

Hortin et al.

[11] Patent Number: 5,542,264

[45] Date of Patent: Aug. 6, 1996

[54] WATER RESERVOIR FOR A REFRIGERATOR

[75] Inventors: Gregory G. Hortin, Center Township, Vanderburgh County; Michael H. Fisher, Princeton; Joseph L. Coleman; Scott D. Adams, both of Evansville, Ind.

[73] Assignee: Whirlpool Corporation, Benton Harbor, Mich.

[21] Appl. No.: 500,638

[22] Filed: Jul. 11, 1995

Related U.S. Application Data

[63] Continuation of Ser. No. 162,568, Dec. 6, 1993, abandoned.

[51] Int. Cl.[6] ..... F25D 23/12

[52] U.S. Cl. ..... 62/338; 138/26; 138/103; 138/177; 138/DIG. 8; 138/178; 137/236.1

[58] Field of Search ..... 138/26, 27, 28, 138/103, 106, 107, 118, 177, 178, DIG. 8, DIG. 11; 62/338, 389; 285/157, 124; 137/236.1

[56] References Cited

U.S. PATENT DOCUMENTS

| | | | |
|---|---|---|---|
| 273,379 | 3/1883 | Miller | 138/30 |
| 385,109 | 6/1888 | Garver et al. | 138/177 |
| 871,940 | 11/1907 | Koch | 62/338 |
| 1,019,100 | 3/1912 | Stoll | 62/338 |
| 1,059,370 | 4/1913 | Johnson | 138/28 |
| 1,086,302 | 2/1914 | McClure | 62/389 |
| 1,392,658 | 10/1921 | Roesch | 138/177 |
| 1,683,023 | 9/1928 | Champion | 138/106 |
| 1,928,009 | 9/1933 | Dornier | 138/177 |
| 1,983,766 | 12/1934 | MacCabee | 62/338 |
| 2,103,479 | 12/1937 | Magee | 62/338 |
| 2,156,296 | 5/1939 | Kline | 138/26 |
| 2,258,469 | 10/1941 | Podulsky | 138/26 |
| 2,261,028 | 10/1941 | Hopkins | 138/26 |
| 2,378,214 | 6/1945 | Gottwald | 138/178 |
| 2,434,118 | 1/1948 | Newman | 138/44 |
| 2,751,757 | 6/1956 | Hobb et al. | 62/338 |
| 2,942,432 | 9/1960 | Muffly | 62/338 |
| 3,319,657 | 5/1967 | Nyiri | 138/27 |
| 3,511,415 | 5/1970 | Crowe | 222/146 |
| 3,834,178 | 9/1974 | Pink | 62/338 |
| 3,851,672 | 12/1974 | Vincent et al. | 138/106 |
| 3,982,406 | 9/1976 | Hanson et al. | 62/339 |
| 4,031,745 | 6/1977 | McCarty | 138/DIG. 11 |
| 4,036,620 | 7/1977 | Benasutti et al. | 62/338 |
| 4,050,250 | 9/1977 | Danis | 138/177 |
| 4,056,373 | 11/1977 | Rubin | 138/178 |
| 4,091,836 | 5/1978 | Clazing | 138/DIG. 11 |
| 4,150,558 | 4/1979 | Pohl | 138/45 |
| 4,739,629 | 4/1988 | True | 62/338 |
| 4,809,743 | 3/1989 | Sukimoto et al. | 138/178 |
| 5,004,374 | 4/1991 | Grey | 138/177 |
| 5,017,054 | 5/1991 | Gideon et al. | 138/26 |
| 5,315,845 | 5/1994 | Lee | 62/338 |

FOREIGN PATENT DOCUMENTS

| | | | |
|---|---|---|---|
| 0879057 | 11/1981 | U.S.S.R. | 138/28 |
| 2319 | 2/1885 | United Kingdom | 138/28 |
| 16712 | 7/1895 | United Kingdom | 138/28 |

*Primary Examiner*—James E. Bryant, III
*Attorney, Agent, or Firm*—Thomas J. Roth

[57] ABSTRACT

A water reservoir is provided for a refrigerator. The reservoir is formed as an elongated tubular member bent into a single U-shape with the tubular member having a constant cross section along its length and a constant vertical rise along its length from an inlet to an outlet. The two legs angle upwardly at a common slope and the legs are substantially the same length so that the inlet and outlet are adjacent to one another. The reservoir thus forms a compact shape which fits into a previously unused space behind a crisper drawer within the refrigerator compartment.

14 Claims, 2 Drawing Sheets

34
60
62
64
66
68
70
72
76
80
82
84
88
92
94
96
98
100
102
104
IX
VIII
X

WATER RESERVOIR FOR A REFRIGERATOR

This is a continuation of application Ser. No. 08/162,568, filed Dec. 6, 1993, now abandoned.

BACKGROUND OF THE INVENTION

The present invention relates to a water reservoir for a refrigerator and more particularly for storing water to be dispensed in a chilled state from the refrigerator.

It is known to provide chilled water dispensers in a refrigerator and in doing so it is necessary to provide a reservoir for holding a supply of water within the refrigeration compartment such that the water can achieve a chilled state before it is dispensed.

U.S. Pat. Nos. 3,511,415 and 4,739,629 disclose a reservoir composed of a plurality of vertically disposed serpentine passages in which the water is cause to flow up and down through a number of legs leading from an inlet to an outlet. Special passages are provided along a top edge between adjacent vertical legs to permit air to flow directly toward the outlet.

U.S. Pat. Nos. 3,834,178; 3,982,406 and 4,036,620 disclose water reservoirs where the water flow is essentially horizontal. The '178 and '620 patents disclose the use of internal walls or baffles to provide varying internal dimensions and configurations to cause the water flowing through the reservoir to swirl and create turbulence. The '406 patent utilizes a plurality of horizontal legs connected with vertical bights and a final angled leg leading from the inlet to the outlet.

Each of the reservoirs disclose take up a significant volume of useable space within the refrigerator cabinet, thereby reducing the available volume within the refrigerator for storage of food items.

SUMMARY OF THE INVENTION

The present invention provides a greatly simplified water reservoir for use in a refrigerator which occupies a very small volume within the refrigerator, in a space which previously has been unused space behind the crisper pans and under the crisper pan cover in the refrigerator. The water reservoir is a tubular member having a single bend forming a U-shape of two substantially horizontal legs connected by a horizontal bight so as to be laterally positioned side-by-side. An inlet is formed at an end of one of the legs opposite the bight and an outlet is formed at an end of the other of the legs opposite the bight.

The legs have a constant cross section along their longitudinal length which is generally rectangular with two opposed flat walls and two remaining outwardly convex walls. The legs extend at a fixed lateral distance apart from one another and are slightly angled relative to one another horizontally. The slope of the legs leads upwardly from the inlet to the bight and then from the bight to the outlet at a constant angle. The two legs are approximately the same length and thus the inlet and outlet are located laterally adjacent to one another. An integrally formed mounting tab is formed at the bight to hold the bight slightly elevated to compensate for the rise of the inlet leg. By configuring the water reservoir in this fashion, it is able to fit in the unused space behind the crisper drawer and thus provides the necessary volume of water storage without reducing the useable volume of space within the refrigerator compartment.

DETAILED DESCRIPTION OF THE PREFERRED EMBODIMENTS

Figure 1:
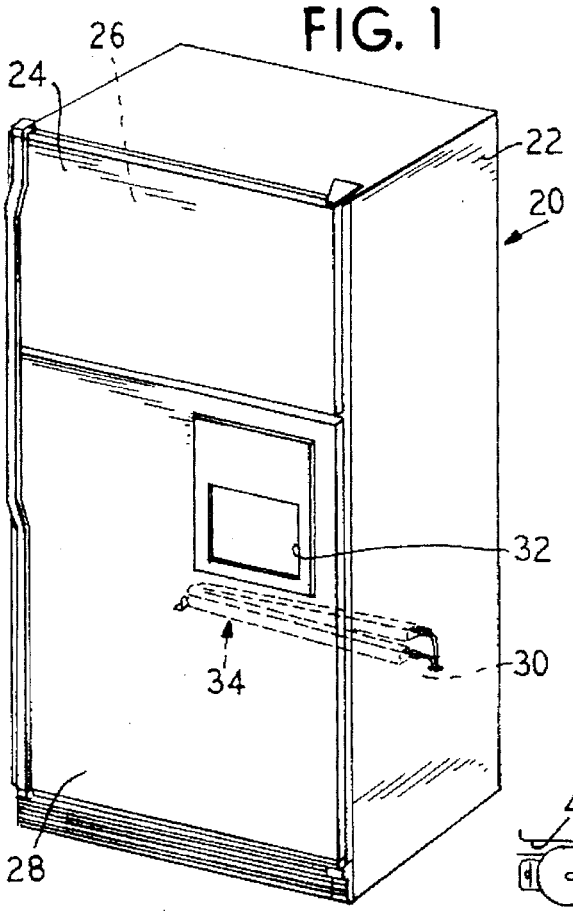
FIG. 1 is a perspective view of a refrigerator schematically illustrating the placement of the water reservoir of the present invention.
Figure 5:
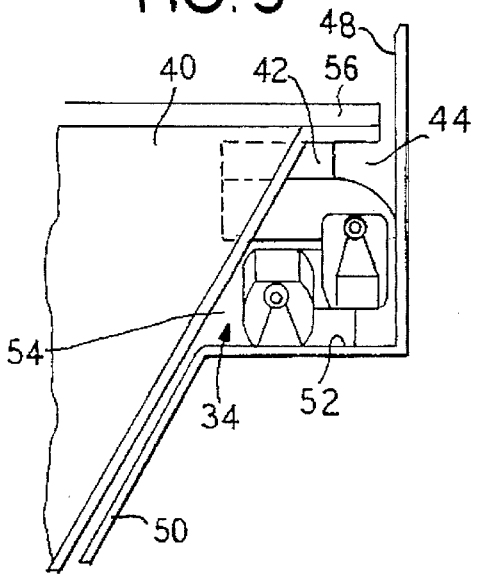
FIG. 5 is a side sectional view of the water reservoir in the refrigerator.
Figure 3:
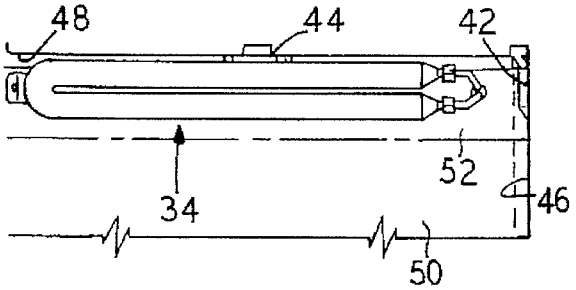
FIG. 3 is a plan view of the water reservoir in place.
Figure 2:
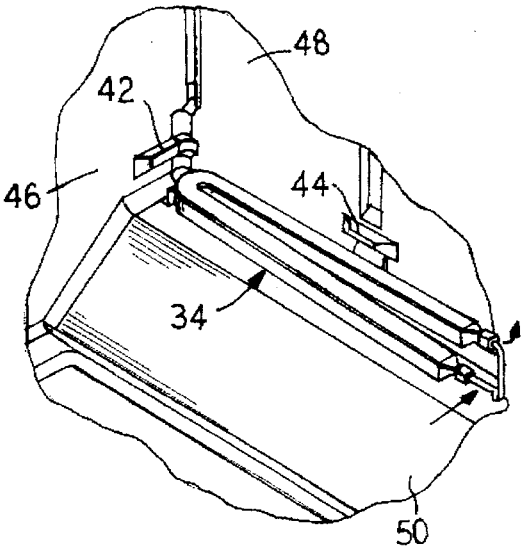
FIG. 2 is a partial perspective view of the interior of the refrigerator of FIG. 1 illustrating the placement of the water reservoir.
Figure 4:
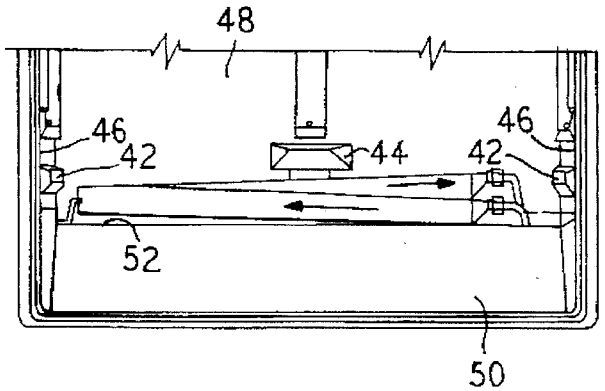
FIG. 4 is a front elevational view of the water reservoir in place.

In FIG. 1 there is shown generally a refrigeration appliance at 20 which comprises an exterior cabinet 22 having a first openable door 24 to expose a first interior compartment 26 and a second openable door 28 to expose a second interior compartment 30. Within each of the compartments 26, 30 there may be one or more shelves (not shown) for receiving food articles. Generally in the arrangement shown, the compartment 26 will be maintained at a temperature sufficiently below 0° C. to assure that all of the articles contained within that compartment will be maintained in a frozen state. The second compartment 30 generally is maintained somewhat above 0° C. to maintain the items placed therein in a chilled, but not frozen condition.

A receptacle 32 is illustrated as being placed within the door 28 of the refrigeration compartment and the use of these receptacles is known for providing access to a chilled water dispenser. The water is chilled by means of a water reservoir 34 positioned within the refrigeration compartment 30 as indicated in phantom in FIG. 1.

FIGS. 2–5 show the water reservoir 34 in position within the refrigeration compartment 30.

In a lower portion of the compartment 30 there are normally provided crisper bins 40 which are supported on tracks 42, 44 formed on the sidewalls 46 and rear wall 48 of the compartment liner, respectively. A lower rear portion of the refrigerator compartment has an angled rear wall portion 50 behind which are mounted the compressor, the condenser and other mechanical portions of the refrigeration equipment. The lower sloped rear wall 50 of the refrigeration compartment liner levels off to a horizontal wall 52 providing a shelf before adjoining with the upper rear wall 48 of the liner. Thus, a pocket or space 54 is located behind the crisper bin 40 and below a top shelf 56 of the crisper bin. The water reservoir 34 of the present invention is located in this previously unused space.

In order to be accommodated in this space, the water reservoir 34 is configured as shown in greater detail in FIGS. 6–11. In these Figures it is seen that the water reservoir 34 is a tubular member bent into a single U-shape having two legs 60, 62 connected by a bight 64. An inlet 66 is formed at an end 68 of one leg 60 opposite the bight 64 and an outlet 70 is formed at an end 72 of the other leg 62 opposite the bight 64. Preferably the reservoir consists of polypropylene and this permits the integral formation of a mounting tab 76 at the bight 64.

Figures 6, 7, 8, 9, 10, 11:
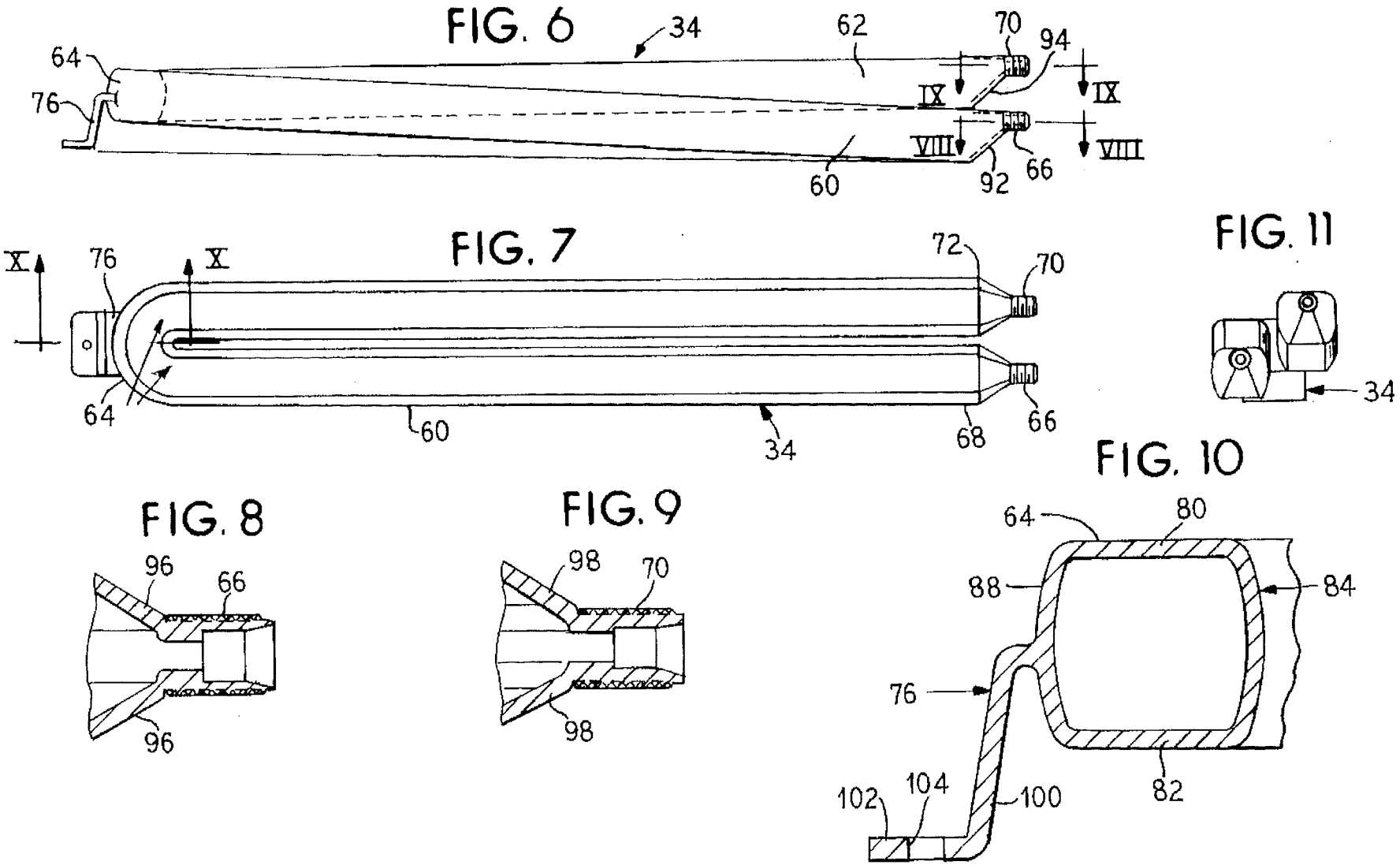
FIG. 6 is a front elevational view of the water reservoir alone.
FIG. 7 is a plan view of the water reservoir alone.
FIG. 8 is a sectional view taken generally along the line VIII—VIII of FIG. 6.
FIG. 9 is a sectional view taken generally along the line IX—IX of FIG. 6.
FIG. 10 is a sectional view taken generally along the line X—X of FIG. 7.
FIG. 11 is an end elevational view of the water reservoir of FIG. 6.

The legs 60, 62 and the bight 64 have a generally rectangular cross section as seen in FIG. 10 and this cross section size remains constant along the length of the legs and bight. The cross section is formed of two opposed flat walls 80, 82 forming the top and bottom walls respectively and two outwardly convex sidewalls 84, 88. The two opposed flat walls 80, 82 permit accommodation of expansion in the event that the water carried within the reservoir 34 freezes.

The legs 60, 62 are angled slightly from horizontal and there is a continuous rise in the inlet leg 60 leading from the inlet 66 to the bight 64 and this rise continues at the same rate from the bight 64 to the outlet 70 in the outlet leg 62. The rise to run ratio is at least 0.023 and preferably is about 0.030.

The bight 64 extends horizontally through 180°, thus the two legs 60, 62 extend side-by-side at a fixed lateral distance apart from one another as viewed vertically from above as shown in FIG. 7. In a front view as shown in FIG. 6, the legs are angled slightly relative to one another in a vertical direction.

The legs 60, 62 are of substantially the same length, just short of an interior width of the refrigeration cabinet and therefore the inlet 66 and outlet 70 are located laterally adjacent to one another.

The continuous rise of the reservoir 34 from the inlet 66 to the outlet 70 serves two purposes. First, it clears the air from the reservoir 34 upon the initial fill and secondly it prevents any air from forming in the reservoir during usage. In order to prevent air entrapment, the inlet 66 and outlet 70 ports are located the highest point of each end of the reservoir 34. The inlet 66 and outlet 70 have a bottom wall 92, 94, respectively which tapers into the-ports at approximately a 45° angle to horizontal. Sidewalls 96, 98 respectively taper into the port at approximately a 30° angle. The inlet 66 and outlet 70 ports transition the rectangular internal cross section of the legs 60, 62 to a round cross section to receive a standard compression fitting.

The integrally formed bracket 76 has a substantially vertical leg 100 extending downwardly to a horizontal foot 102 that has an aperture 104 therethrough. The foot 102 rests on the shelf 52 inside the refrigerator and the aperture 104 receives a threaded fastener. The leg 100 is sized to hold the bight 64 above the shelf 52 due to the rise in the height of the inlet leg 60.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A refrigerator comprising:

a cabinet with at least one open faced compartment being sealed by a refrigerator door, the compartment comprising vertically extending opposing sidewalls, a vertically extending back wall and a bottom wall, the bottom wall comprising a horizontally orientated floor portion extending from the open face of the compartment toward the back wall, an upwardly angled portion extending from the floor portion toward the back wall, and a horizontally extending shelf portion extending from the angled portion to the back wall, a drawer provided in the refrigerator and being defined in part by a bottom wall and a rear wall generally conforming and corresponding to the shape of the floor portion and the angled portion of the bottom wall of the refrigerator when the drawer is in a closed position, and the rear wall being of greater length than the angled portion so that the rear wall extends beyond the angled portion, a pocket defined by the shelf portion, back wall and the rear wall, and a water reservoir comprising an elongated tubular member having a laterally spaced first and second legs connected by a bight portion, one of the legs being angled upwardly to form a positive acute angle relative to a horizontal plane passing through the bight portion, and the other of the legs being angled downwardly to form a negative acute angle relative to the horizontal plane, and each leg having a terminal end opposite the bight portion with an inlet provided on the terminal end of the downwardly angled leg and an outlet provided on the terminal end of the upwardly angled leg, wherein the angular and lateral separation of the legs is such that the water reservoir is dimensioned to fit within the pocket.

2. A refrigerator as claimed in claim 1, wherein the pocket has a generally triangular cross section and the first leg is closest to the rear wall and angled downwardly so that the terminal end of the first leg is generally positioned near one vertice of the triangular cross section and the terminal end of the second leg is positioned near another vertice of the triangular cross section whereby the shape of the elongated generally fills the pocket to maximize the volume of the elongated tube.

3. A refrigerator as claimed in claim 2, wherein the tubular member has a generally rectangular cross section.

4. A refrigerator as claimed in claim 3, wherein the rectangular cross section of the tubular member has two opposed flat walls and two opposed outwardly convex walls.

5. A refrigerator as claimed in claim 1, wherein the acute angles of the legs are equal relative to the horizontal.

6. A refrigerator as claimed in claim 5, wherein the acute angles have a rise to run ratio of at least 0.023.

7. A refrigerator as claimed in claim 1, wherein the tubular member has an integrally formed mounting tab.

8. A water reservoir for a refrigerator having a cabinet with at least one open front compartment being sealed by a refrigerator door, the open front compartment being defined in part by a back wall and a bottom wall with a shelf, and a drawer with a rear wall wherein a pocket is defined in part by the shelf and the rear wall, the water reservoir comprising:

a water reservoir comprising an elongated tubular member having a laterally spaced first and second legs connected by a bight portion, one of the legs being angled upwardly to form a positive acute angle relative to a horizontal plane passing through the bight portion, and the other of the legs being angled downwardly to form a negative acute angle relative to the horizontal plane, and each leg having a terminal end opposite the bight portion with an inlet provided on the terminal end of the downwardly angled leg and an outlet provided on the terminal end of the upwardly angled leg, wherein the angular and lateral separation of the legs is such that the water reservoir is dimensioned to fit within the pocket.

9. A water reservoir as claimed in claim 8, wherein the pocket has a generally triangular cross section and the first leg is closest to the rear wall and angled downwardly so that the terminal end of the first leg is generally positioned near one vertice of the triangular cross section and the terminal end of the second leg is positioned near another vertice of the triangular cross section whereby the shape of the elongated generally fills the pocket to maximize the volume of the elongated tube.

10. A water reservoir as claimed in claim 9, wherein the tubular member has a generally rectangular cross section.

11. A water reservoir as claimed in claim 10, wherein the rectangular cross section of the tubular member has two opposed flat walls and two opposed outwardly convex walls.

12. A water reservoir as claimed in claim 8, wherein the acute angles of the legs are equal relative to the horizontal.

13. A water reservoir as claimed in claim 12, wherein the acute angles have a rise to run ratio of at least 0.023.

14. A water reservoir as claimed in claim 8, wherein the tubular member has an integrally formed mounting tab.

* * * * *